United States Patent [19]

Wyke

[11] 4,433,855

[45] Feb. 28, 1984

[54] SNOW SKI

[76] Inventor: Paul R. Wyke, c/o Holmgren, 2809 "R" St. SE., Auburn, Wash. 98002

[21] Appl. No.: 299,883

[22] Filed: Sep. 8, 1981

Related U.S. Application Data

[63] Continuation-in-part of Ser. No. 145,569, Jun. 6, 1980, abandoned.

[51] Int. Cl.[3] ..... A63C 5/04

[52] U.S. Cl. ..... 280/609

[58] Field of Search ..... 280/609, 608, 601, 28, 280/610; 441/68, 74

[56] References Cited

U.S. PATENT DOCUMENTS

| | | | |
|---|---|---|---|
| Re. 29,659 | 6/1978 | Bildner | 280/608 |
| 3,027,575 | 4/1962 | Fortin | 280/609 |

FOREIGN PATENT DOCUMENTS

| | | | |
|---|---|---|---|
| 169173 | 2/1951 | Austria | 280/608 |
| 435061 | 10/1926 | Fed. Rep. of Germany | 280/609 |
| 739130 | 9/1943 | Fed. Rep. of Germany | 280/609 |
| 1958349 | 11/1969 | Fed. Rep. of Germany | 280/609 |
| 2833112 | 2/1980 | Fed. Rep. of Germany | 280/609 |
| 628308 | 11/1961 | Italy | 280/609 |
| 408734 | 9/1966 | Switzerland | 280/609 |

*Primary Examiner*—David M. Mitchell

*Attorney, Agent, or Firm*—Joan H. Pauly; Delbert J. Barnard

[57] ABSTRACT

A running surface (4) extends between lower side edges (12) and is transversely concave in the front and central regions of the ski (2) and, at the rear of the ski (2), gradually changes to a transverse shape which facilitates sideways sliding. The lower side edges (12) bite into the snow. This biting action and the shape of the running surface (4) permit a skier to move faster and to turn by merely tilting the ski (2) up on one of its lower side edges (12).

14 Claims, 19 Drawing Figures

2
4
5
6
8
12
22
X

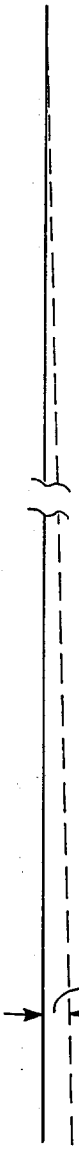
Fig. 13
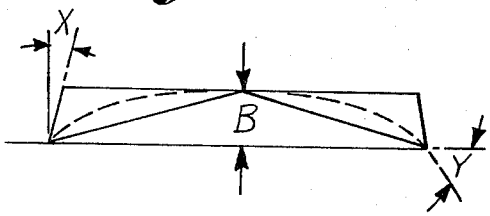
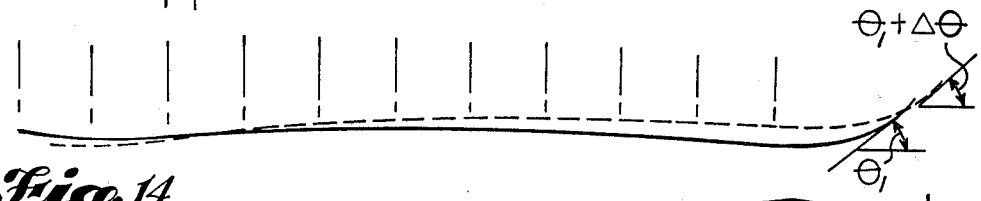
Fig. 14
Fig. 15
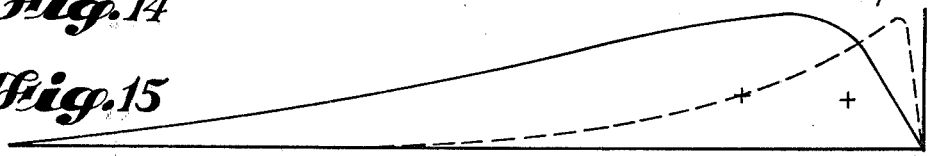

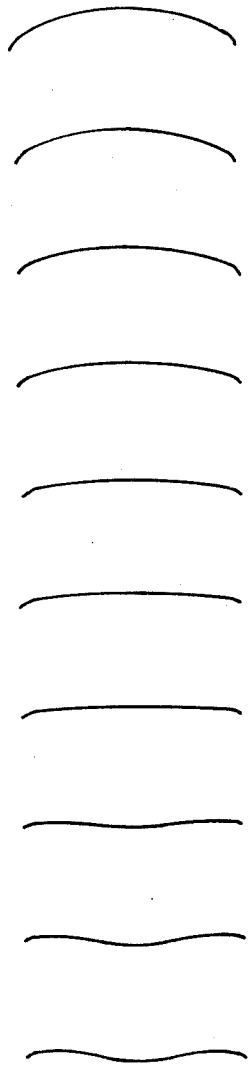
Fig. 16
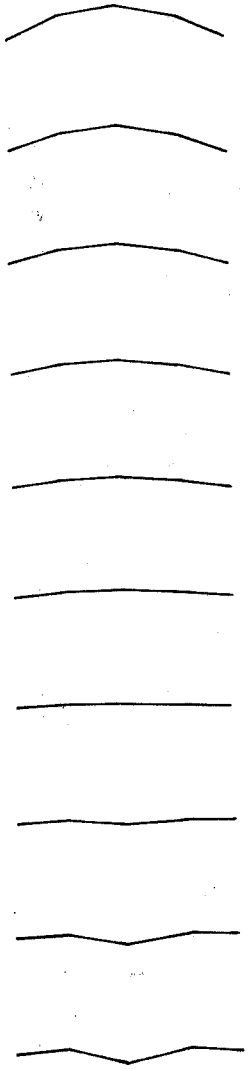
Fig. 17
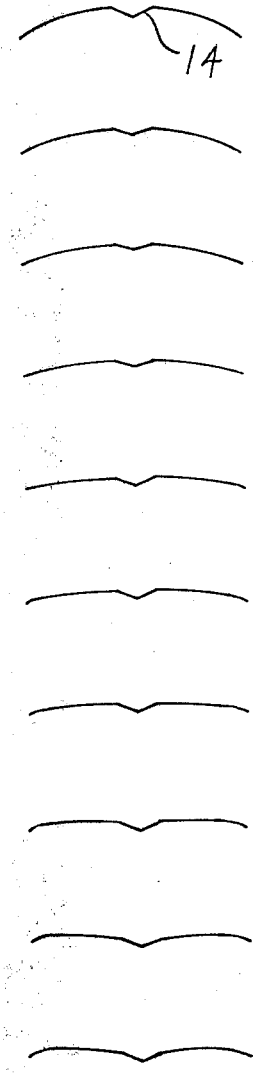
Fig. 18
Fig. 19
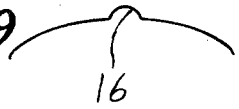

SNOW SKI

RELATED APPLICATION

This application is a continuation-in-part of applicant's copending application, Ser. No. 145,569, filed June 6, 1980, and entitled An Improved Ski of Varying Bottom Shape, now abandoned.

DESCRIPTION

1. Technical Field

This invention relates to snow skis and, more particularly, to a ski with a running surface that varies longitudinally and lower side edges that bite into the snow, providing improved speed and directional stability.

2. Background Art

Snow skis have been used by mankind for thousands of years. During most of that time, there were no major changes in the basic structure of the ski. In modern times, there has been a great deal of activity aimed at improving the bindings, the materials used, and the methods of manufacture, but there has been little change in the shape of the ski. The typical ski still has a running surface that is essentially flat.

There are numerous problems associated with a flat running surface. A ski with such a running surface presents a blunt front end to the snow through which it is moving and has a center of lift that is very near its front end. These characteristics are associated with a large amount of drag or surface friction, which reduces the speed of the ski both in straight line motion and in turning. A ski with a flat running surface is also subject to sideways sliding and skidding because the lower side edges of the ski do not bite into the snow. This lack of directional stability is particularly troublesome in turning because it increases the turning radius and contributes to loss of speed. The turning radius and loss of speed are further increased by the necessity for shifting the ski up onto one of its lower side edges before entering into a turn. This shifting causes the lower side edges to dig into the snow to a degree sufficient to make turning possible but insufficient to prevent sideways sliding.

The conventional method of dealing with the directional instability of a flat ski is to add one or more longitudinal grooves to the running surface. This does increase the directional stability somewhat, provided the skier has a good deal of strength and skill. However, the amount of improvement is, at best, marginally satisfactory, and the grooving of the running surface increases surface friction and, therefore, has the desirable side effect of reducing the ski's speed.

In recent years, the expansion of the ski industry and increased interest and activity in international competition have created a demand for a ski with better speed and directional stability than the typical ski with a grooved flat running surface. German Pat. No. 435 061, granted Oct. 7, 1926, to Karl Schoner; and West German Patent Application No. 1958 349, submitted Nov. 20, 1969, by Leopold F. Schmid, disclose skis that are claimed to have the desired superior speed and directional stability. The ski disclosed by each of these documents has a running surface that is concave at the center and flat or convex (Schoner), or convex (Schmid), at the front end as well as the rear end. Although both of these documents claim that the ski disclosed provides security against sideways sliding, neither provides a convincing explanation as to how a flat or convex front end could accomplish such a result.

The above described documents, together with the prior art cited in them, should be carefully considered for the purpose of properly evaluating the present invention and putting it into proper perspective relative to the prior art.

DISCLOSURE OF THE INVENTION

This invention relates to a novel snow ski. The principal novel feature is the shape of the running surface, which extends between essentially parallel lower side edges. In its basic form, the running surface is transversely concave in the front and central regions of the ski and, at the rear of the ski, gradually changes to a transverse shape which facilitates sideways sliding. In other words, rearward of the central region of the ski resistance to sideways sliding is gradually reduced. In the preferred embodiment, the running surface at the rear of the ski is partially transversely convex to facilitate sideways sliding of the rear of the ski while maintaining overall stability. The running surface, irrespective of its exact shape at the rear, permits a skier to easily turn the ski by merely tilting it up on one of its lower side edges. Since the lower side edges are always biting into the snow, the amount of tilt required for turning is quite small; and since the lower side edges are essentially parallel, the ski is free from the unnecessary additional drag produced by the conventional hourglass shape.

An example of a ski constructed according to this invention is one in which, starting from one side of the running surface and continuing across the ski to the opposite side of the running surface, there are increases and decreases in the angle of attack of the longitudinal profile sections. These increases and decreases are symmetrical about the transverse center of the ski. A ski with such a running surface not only turns easily, but also moves faster than conventional skis because the shape of the running surface decreases the overall angle of attack of the ski and, thus, reduces drag.

Skis constructed according to the invention characteristically have a center of lift that is closer to the skier and the skier's center of gravity than the center of lift in a conventional ski. The rearward shift in the center of lift improves control and makes a long, low angle of attack possible, thus reducing drag. The shift is created mainly by the transverse concavity of the front end of the running surface and may be accentuated by the transverse shape of the rear end.

A ski constructed according to the invention may advantageously include additional features. One such feature is sidewalls that extend upwardly from the lower side edges to the top surface of the ski and that slant toward one another from bottom to top over at least a portion of the length of the side edges, so that each transverse cross section of the ski within such portion of the length of the side edges has a greater width between the side edges than at the top surface. This slant increases the sharpness of the bite of the lower side edges, thereby increasing directional stability and further minimizing drag.

The primary objects of this invention are to provide a ski with superior turning speed and stability and to provide a ski that moves faster in straight lines.

These and other objects, advantages, and features will become apparent from the detailed description of the preferred embodiment that follows.

BRIEF DESCRIPTION OF THE DRAWINGS

In the drawings, like element designations refer to like parts throughout, and:

FIG. 13 is a parameter diagram showing the limits of the transverse curvature of the running surface in the region where the running surface first contacts the snow.

FIG. 14 is a representation of the generation of the running surface of the preferred embodiment, indicating the lower side edges of the ski by a solid line and the transverse center of the running surface, in exaggerated form, by a broken line.

FIG. 15 shows the characteristic pressure curves of a running surface generated as in FIG. 14 (solid line) and a conventional flat running surface (broken line).

FIG. 16 shows the transverse curvature of the running surface at the multiple points along the ski designated in FIG. 14.

FIG. 17 is similar to FIG. 16 except that the smooth curves of FIG. 16 are represented by sections of many-sided polygons.

FIG. 18 is similar to FIG. 16 except that it further includes a ridge extending longitudinally along the transverse center of the running surface.

FIG. 19 shows the frontmost profile illustrated in FIG. 16 with the additional feature of a longitudinal groove.

DESCRIPTION OF THE PREFERRED EMBODIMENT

The drawings show a ski 2 that is constructed according to the invention and that also constitutes the best mode of the invention currently known to the applicant. The main novel feature of the invention is the shape of the running surface 4. This running surface 4 extends between lower side edges 12, which bite into the snow and, for reduced drag, are essentially parallel to each other. The running surface 4 is transversely concave in the front and central regions of the ski 2 and, at the rear of the ski 2, gradually changes to a transverse shape which facilitates sideways sliding. In other words, at the rear of the ski 2 resistance to sideways sliding is gradually reduced to facilitate sideways sliding at the rear of the ski 2. The shape of the running surface 4 and the bite of the lower side edges 12 permit a skier to easily turn the ski 2 by merely tilting it slightly up on one of its lower side edges 12.

It is important to note that, for the purposes of this disclosure, "running surface" does not have its common meaning but rather is defined functionally to mean that part of the bottom of the ski which contacts the snow, excluding incidental spray, when the ski is in use. Therefore, when the ski 2 is placed on a flat hard surface, a portion of the running surface 4 extends upwardly and forwardly from the frontmost point of contact between the hard surface and the ski 2. This necessarily means that a portion of the transversely concave region of the bottom of the ski 2 and the parallel lower side edges 12 also so extend upwardly and forwardly.

Figures 1, 2, 3, 4, 5, 6:
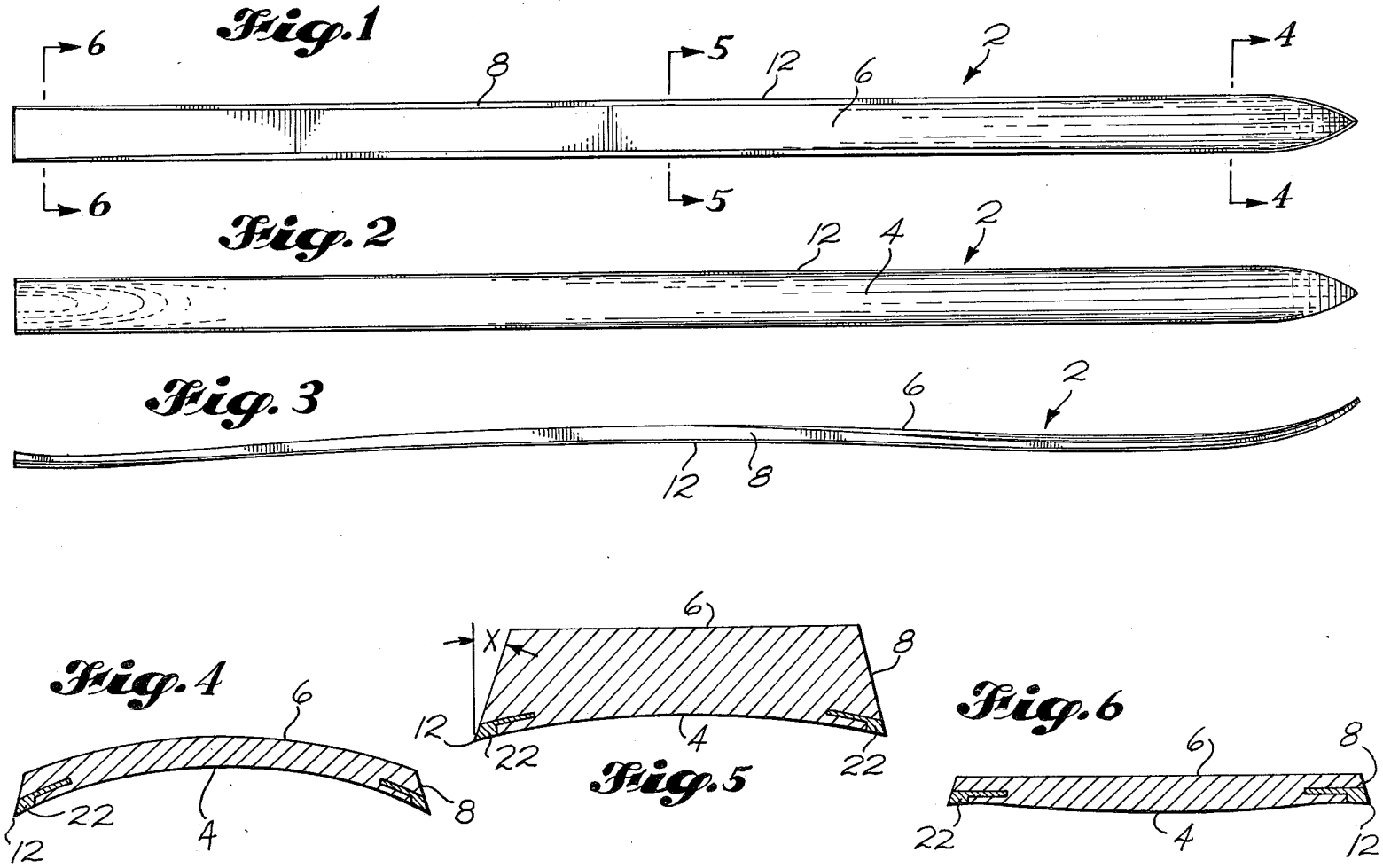
FIG. 1 is a top plan view of the preferred embodiment of the invention.
FIG. 2 is a bottom plan view of the preferred embodiment with typical contour lines represented by broken lines.
FIG. 3 is a side elevational view of the preferred embodiment.
FIG. 4 is a sectional view taken along the line 4—4 of FIG. 1.
FIG. 5 is a sectional view taken along the line 5—5 of FIG. 1.
FIG. 6 is a sectional view taken along the line 6—6 of FIG. 1.

In the preferred embodiment, the running surface 4 is partially transversely convex at the rear of the ski 2. As shown in FIG. 6, the preferred transverse profile of the rear running surface 4 is convex at the transverse center and slightly concave toward the side edges 12. Although this is the preferred configuration, other embodiments of the invention might have running surfaces with different transverse profiles at the rear. For example, the profile might be flat, or it might be entirely convex.

Whatever the exact shape of the transverse profile of the running surface 4 at the rear of the ski 2, the longitudinal profile of the running surface 4 preferably conforms with the conventional shape. As shown in FIGS. 3 and 14, the longitudinal profile of the running surface 4 of the preferred embodiment, at each longitudinal section across the width of the running surface 4, is concave through a substantial portion of the length of the running surface 4 and at its front end becomes convex and then curves upwardly. The concavity of the longitudinal profile creates a spring effect so that, when a skier is standing on the skis 2, the longitudinal profile of the lower side edges 12 levels out to the flatness desired for a ski in use. Without such spring effect, the limitations of the materials used in making skis would cause the ski to have an undesirable sag and the skier would exert less pressure on the rear and front control areas. As in conventional skis, in the longitudinal profile of the entire ski 2 of the preferred embodiment the upward curve continues from the front end of the running surface 4 along the wedge shaped tip of the ski 2, the bottom surface of which does not contact the snow when the ski 2 is being used and, thus, does not form part of the running surface 4. Both conventional skis and the preferred embodiment of this invention also have a slight upward turn at the rear of the longitudinal profile, such turn being of the order of magnitude of ¼ inch long and serving to allow backward motion without jamming the ski 2 into the snow.

In the preferred embodiment, there are increases and decreases in the angle of attack of the longitudinal profile sections at any particular transverse cross section of the ski 2 when the angle of attack is measured at intervals starting at one side of the running surface 4 and continuing across the ski 2 to the opposite side of the running surface 4. These increases and decreases are symmetrical about the transverse center of the ski 2. It should be noted that in this disclosure "angle of attack" is used to mean the angle, measured from the horizontal, at which the snow contacts or puts pressure on any particular point of the running surface 4 of the ski 2. Thus, any point on the running surface 4 which contacts the snow can meaningfully be said to have a characteristic angle of attack.

The preferred pattern for the increases and decreases in the angle of attack described in the preceding paragraph is one in which the successive longitudinal profile sections of the running surface 4 increase in angle of attack gradually up to the transverse center of the ski 2 and then gradually decrease in angle of attack symmetrically down to the opposite side. One method of producing these specified changes in the angle of attack of successive longitudinal profile sections is illustrated in FIG. 14. As can be seen in FIG. 14, the running surface 4 is developed by rotating at least similar longitudinal profile shapes in position about an axis which extends transversely of the ski 2 and is offset from the ski 2. The preferred position for the axis is above a rear portion of the ski 2, as shown in FIG. 14. The use of identical longitudinal profile shapes simplifies manufacture and produces a running surface 4 with the desired characteristics. As noted above, the longitudinal profile shape used in the preferred embodiment is basically the conventional shape.

Ideally, one would use an infinite number of profiles, each having zero transverse thickness, and rotate each profile separately to obtain the smooth curve shown in FIG. 16. In actual practice, a very large number of very thin profiles is used to produce the many-sided polygons shown in FIG. 17, and the polygonal surface is then finished to obtain a smoothly curved surface. This manufacturing process is further described below.

When identical longitudinal profile shapes are used and the surface generated is finished, the result is a running surface 4 which has the same longitudinal profile shape at any point across its width. Although the profile shape is constant, the fact that each longitudinal profile section is rotated a different amount creates a slight longitudinal shift in the longitudinal profile curve as it moves across the width of the running surface 4. This shift increases gradually up to the transverse center of the running surface 4 and then gradually decreases symmetrically down to the opposite side. Rotating identical profile shapes as shown in FIG. 14 also produces elliptical contour lines at the rear of the running surface 4, illustrated by the dotted lines in FIG. 2. This elliptical contour has functional significance to be discussed below. The slight upturn at the rear of the ski 2 is fashioned after the running surface 4 has been developed, as part of the process of finishing the ski 2.

The exact configuration of the running surface 4 generated as shown in FIG. 14 is most clearly visible in FIG. 16. The concavity is most pronounced at the front of the running surface 4 and gradually decreases toward the rear. Behind the pivotal point of each longitudinal profile section, a slight convexity begins to develop at the transverse center of the running surface 4. Since this convexity is superimposed on the concavity, the sides of the transverse profile remain concave. However, the convexity and the width of the convex portion increase toward the rear, and the convex portion would entirely engulf the concave portions if the rear of the ski 2 were sufficiently longer.

A variation of the above-described method for developing the running surface 4 is rotating similar or identical longitudinal profile shapes in position about an axis which extends transversely through the ski 2, rather than about an axis which is offset from the ski 2. The axis preferably extends transversely through a rear portion of the ski 2. This produces the specified changes in the angle of attack, but the elliptical contour obtained by rotating the profile shapes about an axis which is offset from the ski 2 is reversed with the curved end being located at the rear end of the running surface 4. In the case of an axis extending transversely through the rear end of the ski 2, the elliptical contour disappears entirely and the rear end of the running surface 4 is flat.

For most uses, it is preferable to have a running surface 4 that is curved smoothly. In other words, it is generally desirable to have a running surface 4 in which, starting from one side of the running surface 4 and continuing across the ski 2 to the opposite side, the successive longitudinal profile sections increase in angle of attack gradually up to the transverse center and then gradually decrease in angle of attack down to the opposite side without any local deviations. Although this smooth curve is generally the desired configuration, variations may be made without significantly affecting the performance of the ski 2, and these variations may provide better performance in certain specified conditions. An example of such a variation, is a longitudinal ridge 14 projecting from a portion of the transversely concave region of the running surface 4. Such a ridge 14 would generally be gradually flattened at its rear end. Another such variation is a longitudinal groove 16 extending along a portion of the transversely concave region of the running surface 4. Such a groove 16 would generally decrease gradually in depth at its rear end. Either a ridge 14 or a groove 16 might extend along a portion of the concave region of the running surface 4, the entire length of the concave region of the running surface 4, or even the entire length of the whole running surface 4, as shown in FIG. 18.

A feature that may be advantageously included in a ski constructed according to the invention is sidewalls 8 that slant toward one another. Such sidewalls 8 extend upwardly from the lower side edges 12 to the top surface 6 of the ski 2 and slant toward one another from bottom to top. They may slant toward one another over the entire length of the side edges 12, or they may alternatively slant toward one another over only a portion of the length of the side edges 12. In either case, each transverse cross section of the ski 2 within the region with the slanting sidewalls 8 has a greater width between the side edges 12 than at the top surface 6. In the preferred embodiment, the sidewalls 8 slant toward one another over the entire length of the side edges 12, and both sidewalls 8 at successive transverse cross sections over such entire length form a constant predetermined angle x (FIG. 5) with a vertical axis. This constant angle greatly simplifies manufacture, and the resulting ski 2 is attractive and has the desired characteristics produced by the slant.

An additional feature of the preferred embodiment is the provision of protective strips 22 along the lower side edges 12. These strips 22 are conventional and are made of some wear-resistant material, such as metal. They extend the life of the ski 2 by reducing normal wear and preventing damage from contact with rocks or other hard objects.

Although the various parameters of the ski 2 may vary considerably, testing of the ski 2 has yielded results that indicate the probable optimum values for certain parameters. The height of the transverse concave curve at the leading edge of the running surface 4 (B in FIG. 13) is ⅜ inch in the preferred embodiment. The angle X of the slant of the sidewalls 8 is, for most skiing situations, preferably about 15 degrees. Angle Y (FIG. 13) is formed by the horizontal and the tangent to the transverse concave curve of the leading edge of the running surface 4 at the lower side edge 12. It has a preferred value of about 30 degrees.

Skis constructed according to the invention, whatever the specific details of design, provide performance superior to that of conventional skis with basically flat running surfaces and skis with running surfaces that vary in configuration in conformity with known patterns. Skis constructed according to the invention offer low glide resistance and superior directional stability. Therefore, they offer superior speed and efficiency in straight line skiing and turning. The latter is more easily accomplished because, in order to turn, the skier need only tilt the skis 2 slightly on their side edges 12 and because the construction of the skis 2 minimizes, if not eliminates, sideways sliding. In turns, the running surface 4 of the ski 2 acts like a plow blade pushing the snow off to the side without creating the unnecessary drag that would result from the piling up or accumulation of snow at points along the running surface 4.

The superior performance of the ski 2 in straight line skiing is due mainly to the configuration of the running surface 4. This configuration provides a longer lower angle of attack and decreases the overall angle of attack. This minimizes drag and brings the center of lift closer to the skier. The elliptical contour formed at the rear of the running surface 4 with the configuration illustrated in FIG. 16 provides some lift at the rear of the ski 2 which pushes the rear of the ski 2 very slightly up and the front of the ski 2 very slightly down. The effect is to keep the ski 2 level and, therefore, to further reduce drag. The slight rear lift also moves the center of lift, or pressure center, further from the front of the ski 2 and still closer to the skier.

Figure 8:
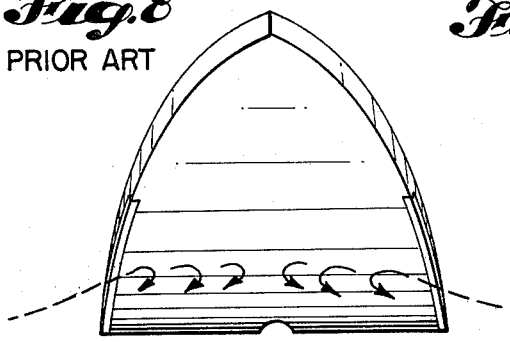
Fig. 8 PRIOR ART
FIG. 8 is similar to FIG. 7 except that it shows a conventional ski with a flat running surface with a groove extending longitudinally down the center, and the arrows represent turbulence.
Figure 7:
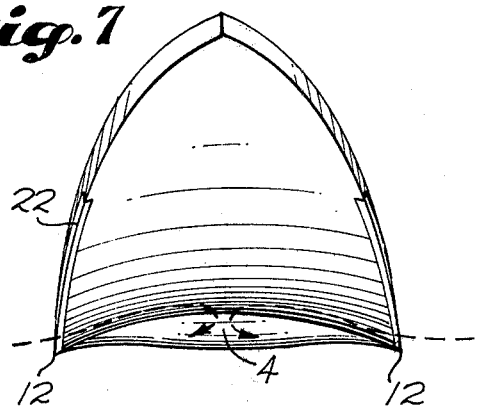
FIG. 7 is a front elevational view of the preferred embodiment with the snow line at the front of the ski during forward motion represented by a broken line and flow under the ski represented by arrows.

FIGS. 7 and 8 illustrate the performance of the ski 2 of this invention and a conventional ski in straight line motion in snow conditions consisting of approximately ½ inch of powder over hardpack. As can be seen in FIG. 7, the snow flows smoothly under the ski 2 of this invention, and there is no turbulence or build-up of snow at the front end of the ski 2. In contrast, there is a significant amount of both turbulence and snow build-up in front of the conventional ski (FIG. 8). These conditions waste energy and, consequently, reduce the speed of the ski.

FIG. 15 shows the characteristic pressure curves for a running surface 4 generated as shown in FIG. 14 (solid line) and a conventional flat running surface (broken line). The approximate center of area, or centroid, of each curve is indicated by a cross. Since the pressure on the running surface determines the lift acting on that surface, the center of area corresponds to the center of lift. The ski 2 of this invention plainly has a center of lift relatively close to the skier, producing the desired reduction in drag and increase in control.

A ski constructed according to the invention but with a running surface that is flat at its rear end will have somewhat better speed than a ski with a partially convex rear running surface, but this is achieved by sacrificing some turning stability. Whatever the exact configuration of the rear of the running surface 4, the introduction of a longitudinal ridge 14 or groove 16 on the running surface 4 has only a minimal effect on the performance of the ski 2. This minimal effect includes a very slight increase in friction which translates into a very slight increase in drag. Normally, this increase in drag would be a disadvantage. However, it becomes an advantage when the ski 2 is used in extremely wet snow since it increases the stability of the ski 2.

Two other features further improve the performance of the ski 2 in straight line skiing. The first of these is the inclusion of parallel lower side edges 12. Such edges 12 eliminate the waist or inward curve of the lower side edges found in most conventional skis. This waist may have some value for attractiveness, but it introduces additional and unnecessary drag. The second feature is the provision of sidewalls 8 that slant toward each other from bottom to top. The slant increases the biting effect of the edges 12 and, thus, increases the directional stability of the ski 2 and decreases drag as well as the incidence of sideways sliding.

Figure 12:
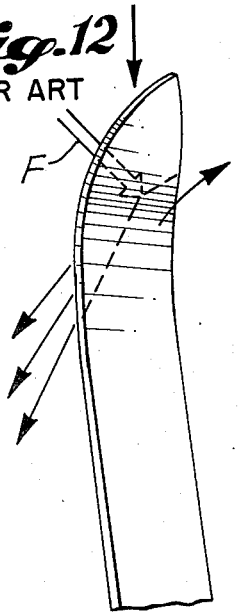
Fig. 12 PRIOR ART
FIG. 12 is similar to FIG. 11 except that it shows a conventional ski with a flat running surface.
Figure 11:
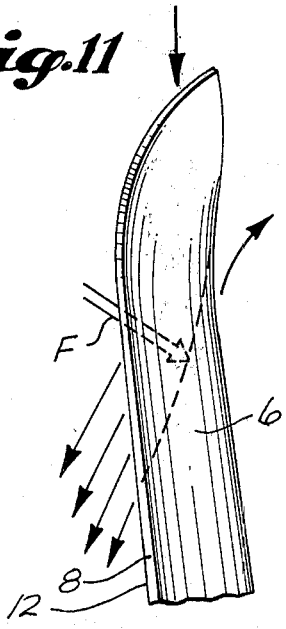
FIG. 11 is a fragmentary top elevational view of the preferred embodiment showing the ski moving in snow and tilted for turning, with the leading edge of the running surface represented by a broken line and the directions of movement of the snow and the ski and the resultant force on the ski represented by arrows.

Skis constructed according to the invention also show superior performance in turning. As with straight line skiing, the superiority of performance is due mainly to the configuration of the running surface 4. In the case of turning, the longer lower angle of attack is particularly critical at the leading edge of the ski 2, the part of the ski which first contacts the snow. The dotted line in FIG. 11 illustrates the leading edge of a ski 2 constructed according to the invention. As FIG. 11 clearly shows, the snow contacts the leading edge almost tangentially, or in other words, the angles of attack along the leading edge are very small. This minimizes drag and prevents the formation of pockets of accumulated snow along the leading edge, which pockets would create drag and decrease the speed of the ski going into and through the turn. For the purpose of comparison, the dotted line in FIG. 12 illustrates the leading edge of a conventional flat ski as it moves into a turn. The bluntness of this leading edge causes drag and results in the formation of pockets of accumulated snow along the leading edge. In skis constructed according to the invention, the leading edge is longer and its bluntness is eliminated, making possible a smooth tangential entry of the ski 2 into the snow and moving the resultant force F on the ski 2 rearward. The shape of the running surface 4 behind the leading edge maintains the low angle of attack in a turn and facilitates the flow of the snow beneath the ski 2 in much the same way as it facilitates the flow of snow beneath the ski 2 when the ski 2 is moving in a straight line.

Figure 10:
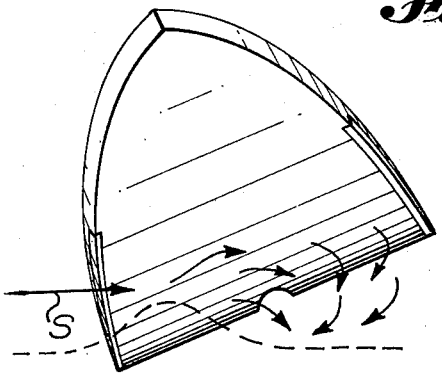
Fig. 10 PRIOR ART
FIG. 10 is similar to FIG. 9 except that it shows the conventional ski shown in FIG. 8.
Figure 9:
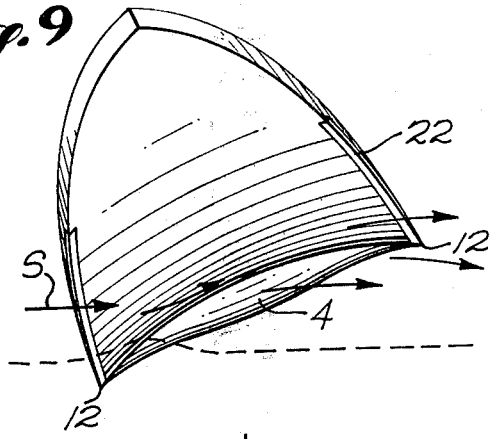
FIG. 9 is similar to FIG. 7 except that the ski is tilted up on one of its side edges for turning, the arrows represent the direction of flow of the snow, and arrow S represents sideways movement.

The relative turning performances of the ski 2 of this invention and a conventional ski are also illustrated by FIGS. 9 and 10. The snow conditions depicted are ½ inch powder over hardpack. FIG. 9 shows the smooth plow-like performance of the ski 2 of this invention. The broken line shows the lack of any significant snow build-up, and the arrows indicate the smooth flow of the snow. On the other hand, FIG. 10 shows the considerable build-up and turbulence at the front of a conventional ski, both of which waste energy and decrease speed. The arrow S in each figure indicates the relative magnitude of sideways sliding.

The effect of parallel lower side edges 12 or the inclusion or omission of longitudinal ridges 14 or grooves 16 on the running surface 4 is the same in turning as it is in straight line skiing. As in straight line skiing, the elimination of the conventional waist by making the lower side edges 12 parallel reduces drag. The effect of including or omitting a longitudinal ridge 14 or groove 16 is again minimal. The increase in friction produced by the inclusion of such features is negligible and has the same advantages and disadvantages as it would with respect to straight line skiing.

The configuration of the running surface 4 and the resulting shape of the lower side edges 12 produces a ski 2 the lower side edges 12 of which are always biting into the snow, whether the ski 2 is moving in a straight line or turning. This causes the ski 2 to perform well even on icy surfaces and makes it possible to move into a turn simply by tilting the skis 2 slightly on their side edges 12. When so tilted, the lower side edges 12 bite further into the snow, and the entry into the turn is smooth without significant sideways slipping. The protection against sideways slipping provided by the biting lower side edges 12 continues throughout the turn and as the ski 2 moves out of the turn back into a straight line. If the side walls 8 are slanted toward one another from bottom to top, the stabilizing effect of the biting lower side edges 12 is enhanced.

When the ski 2 moves into, through and out of a turn, its action is similar to that of a bow shooting an arrow. As the ski 2 goes into the turn, it flexes longitudinal, storing energy. This stored energy is released when the ski 2 moves out of the turn and increases the forward momentum of the ski 2. In other words, as the ski 2 moves into the turn it slows down slightly, but as it moves out of the turn its forward speed is increased. The total effect of the ski's 2 performance is that the turn is made more quickly and, if desired, in a tighter arc than a turn with a conventional ski.

Skis constructed according to the invention also perform exceptionally well in jumping. The configuration of the running surface 4 creates an airfoil and makes possible high and long jumps. Unfortunately, this very characteristic would generally disqualify the use of the ski 2, without modification, in most jumping competition.

As has been amply demonstrated, the ski of this invention performs pre-eminently in straight-line downhill skiing, in turning, including slalom skiing, and in jumping. One area of interest in which the ski 2 does not perform well is in snow plowing and Telemark style skiing involving side-slipping.

Virtually any conventional method of manufacture of skis can be used to manufacture skis constructed according to the invention. Such methods include injection molding the ski into its final shape, injection molding the ski into a blank shape and then milling the blank into the final shape, and laminating the ski to form a blank and then milling the blank. Whatever method is used, the running surface 4 may be developed as shown in FIG. 14 or the mold for the running surface 4 may be similarly developed by use of a computer operated router or like device. The ski may be manufactured from a variety of materials, such as wood, metal, or plastic.

Throughout this disclosure, the terms "concave" and "convex" have been used in reference to the transverse profile of the running surface 4. The use of these terms is intended to be taken in the broadest possible sense, to include at its outer limits a V-shaped surface with two straight legs. Such a V-shaped surface might be pointed at the intersection of the two legs or it might have a curved point at such intersection. The range of possibilities for the concave shape at approximately the leading edge of the ski 2 is illustrated by the solid lines in FIG. 13; the broken line shows the preferred configuration.

It will be obvious to those skilled in the art to which this invention is addressed that the invention may be used to advantage in a variety of situations. Therefore, it is also to be understood by those skilled in the art that various changes, modifications, and omissions in form and detail may be made without departing from the spirit and scope of the present invention as defined by the following claims.

I claim:

1. A snow ski having essentially parallel lower side edges that bite into snow, and a running surface between said edges which has a transverse shape that changes gradually from the front end of the running surface to the rear of the ski and which is transversely concave in the front and central regions of the ski, the concavity in said front and central regions being greatest at said front end and decreasing gradually rearwardly through said front and central regions in a manner that provides a low overall angle of attack and a smooth, almost tangential entry of the ski into snow to facilitate flow of snow beneath the ski and move the center of lift rearward toward the skier, and said transverse shape further decreasing in concavity rearward of said central region toward the rear of the ski to gradually reduce resistance to sideways sliding and thereby facilitate sideways sliding at the rear of the ski; said edges and running surface permitting a skier to easily turn the ski by merely tilting it up on one of said edges.

2. A snow ski according to claim 1, wherein the running surface is at least partially transversely convex at the rear of the ski.

3. A snow ski according to claim 1, wherein the longitudinal profile shape of the running surface, at each longitudinal section across the width of the running surface, is concave through a substantial portion of the length of the running surface and at its front end becomes convex and then curves upwardly.

4. A snow ski according to claim 3, wherein starting from one side of the running surface and continuing across the ski to the opposite side of the running surface, there are increases and decreases in the angle of attack of the longitudinal profile sections, said increases and decreases being symmetrical about the transverse center of the ski.

5. A snow ski according to claim 4, wherein starting from one side of the running surface and continuing across the ski to the opposite side, the successive longitudinal profile sections of the running surface increase in angle of attack gradually up to the transverse center of the ski and then gradually decrease in angle of attack down to the opposite side.

6. A snow ski according to claim 5, wherein the running surface has a geometrical shape that is a development produced by rotating at least similar longitudinal profile shapes in position about an axis which extends transversely of the ski and is offset from the ski, to produce the specified changes in angle of attack of successive longitudinal profile sections of the running surface.

7. A snow ski according to claim 5, wherein the running surface has a geometrical shape that is a development produced by rotating at least similar longitudinal profile shapes in position about an axis which extends transversely through the ski, to produce the specified changes in angle of attack of successive longitudinal profile sections of the running surface.

8. A snow ski according to claim 1 or claim 4, wherein a portion of the transversely concave region of the running surface has a longitudinal ridge projecting therefrom.

9. A snow ski according to claim 1 or claim 4, wherein a longitudinal groove extends along a portion of the transversely concave region of the running surface.

10. A snow ski according to claim 1 or claim 4, further comprising a top surface, and sidewalls extending upwardly from the lower side edges to the top surface, said sidewalls slanting toward one another from bottom to top over at least a portion of the length of the side edges so that each transverse cross section of the ski within such portion of the length of the side edges has a greater width between the side edges than at the top surface.

11. A snow ski according to claim 10, wherein the sidewalls slant toward one another over the entire length of the side edges with both sidewalls at successive transverse cross sections over said entire length forming a substantially constant predetermined angle with a vertical axis.

12. A snow ski according to claim 2, wherein the running surface at the rear of the ski is convex at the transverse center of the ski and slightly concave toward the lower side edges of the ski.

13. A snow ski according to claim 1, wherein rearward of said central region a convex portion of said transverse shape begins to develop at the transverse center of the running surface, said convex portion being superimposed on the decreasing concavity and increasing in convexity and width toward the rear of the ski.

14. A snow ski according to claim 3, wherein the longitudinal profile shape of the running surface is essentially constant across the width of the running surface except for a slight longitudinal shift in the longitudinal profile shape across the width of the running surface, said longitudinal shift increasing gradually from one of the lower side edges up to the transverse center of the running surface and then gradually decreasing symmetrically down to the other side edge.

* * * * *

UNITED STATES PATENT AND TRADEMARK OFFICE

CERTIFICATE OF CORRECTION

PATENT NO. : 4,433,855

DATED : February 28, 1984

INVENTOR(S) : Paul R. Wyke

It is certified that error appears in the above-identified patent and that said Letters Patent is hereby corrected as shown below:

Column 1, line 52, "desirable" should be -- undesirable --.

Signed and Sealed this

*Eighth* Day of *May 1984*

[SEAL]

*Attest:*

GERALD J. MOSSINGHOFF

*Attesting Officer*

*Commissioner of Patents and Trademarks*